US007909093B2

(12) United States Patent
Brown et al.

(10) Patent No.: US 7,909,093 B2
(45) Date of Patent: Mar. 22, 2011

(54) IN SITU COMBUSTION AS ADJACENT FORMATION HEAT SOURCE

(75) Inventors: David Andrew Brown, Katy, TX (US); Wayne Reid Dreher, Jr., Katy, TX (US); Thomas J. Wheeler, Houston, TX (US); Wendell Peter Menard, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 135 days.

(21) Appl. No.: 12/354,270

(22) Filed: Jan. 15, 2009

(65) Prior Publication Data

US 2010/0175872 A1 Jul. 15, 2010

(51) Int. Cl.
*E21B 43/243* (2006.01)
*E21B 43/30* (2006.01)

(52) U.S. Cl. ..... 166/245; 166/50; 166/52; 166/258; 166/272.1; 166/272.6; 166/272.7

(58) Field of Classification Search ..... 166/50, 166/52, 57, 245, 256, 258, 272.1, 272.6, 166/272.7
See application file for complete search history.

(56) References Cited

U.S. PATENT DOCUMENTS

| | | | | | |
|---|---|---|---|---|---|
| 1,722,679 | A | * | 7/1929 | Ranney | 299/2 |
| 2,584,605 | A | * | 2/1952 | Merriam et al. | 166/257 |
| 3,054,448 | A | * | 9/1962 | Dew et al. | 166/257 |
| 3,116,792 | A | | 1/1964 | Purre | |
| 3,159,215 | A | * | 12/1964 | Meldau et al. | 166/258 |
| 3,323,590 | A | * | 6/1967 | Gilchrist et al. | 166/257 |
| 3,554,285 | A | * | 1/1971 | Meldau | 166/258 |
| 3,599,714 | A | * | 8/1971 | Messman et al. | 166/258 |
| 3,924,680 | A | * | 12/1975 | Terry | 166/258 |
| 3,978,920 | A | | 9/1976 | Bandyopadhyay et al. | |
| 4,726,759 | A | | 2/1988 | Wegener | |
| 4,993,490 | A | | 2/1991 | Stephens et al. | |
| 5,055,030 | A | | 10/1991 | Schirmer | |
| 5,339,897 | A | | 8/1994 | Leaute | |
| 6,918,444 | B2 | | 7/2005 | Passey et al. | |
| 2001/0049342 | A1 | * | 12/2001 | Passey et al. | 507/200 |
| 2002/0029881 | A1 | * | 3/2002 | de Rouffignac et al. | 166/244.1 |
| 2008/0135244 | A1 | * | 6/2008 | Miller | 166/272.6 |

* cited by examiner

*Primary Examiner* — George Suchfield

(57) ABSTRACT

Methods and apparatus relate to in situ combustion. Configurations of injection and production wells facilitate the in situ combustion. A first production well disposed in a first oil bearing reservoir is spaced from a second production well disposed in a second oil bearing reservoir separated from the first oil bearing reservoir by a stratum having lower permeability than the first and second oil bearing reservoirs. The stratum isolates one of the first and second production wells from one of the first and second oil bearing reservoirs. In situ combustion through the first oil bearing reservoir generates heat that irradiates into the second oil bearing reservoir to enable producing hydrocarbon with the second production well.

14 Claims, 3 Drawing Sheets

IN SITU COMBUSTION AS ADJACENT FORMATION HEAT SOURCE

CROSS-REFERENCE TO RELATED APPLICATIONS

None

STATEMENT REGARDING FEDERALLY SPONSORED RESEARCH OR DEVELOPMENT

None

FIELD OF THE INVENTION

Embodiments of the invention relate to methods and systems for oil recovery with in situ combustion.

BACKGROUND OF THE INVENTION

In order to recover oils from certain geologic formations, injection of steam increases mobility of the oil within the formation via, for example, a process known as steam assisted gravity drainage (SAGD). Energy needed for steam generation represents a substantial cost for the SAGD. Ability to provide cost efficient recovery of the oils with the SAGD diminishes as zones for oil bearing formations decrease in thickness.

In situ combustion offers another approach for recovering the oil. With in situ combustion, an oxidant injected through an injection well into the formation reacts with some of the oil to propagate a combustion front through the formation. This process heats the oil ahead of the combustion front while the injection gas and combustion gas products drive the oil that is heated toward an adjacent production well.

Vertical stratification further presents problems with respect to recovery processes such as the SAGD and the in situ combustion since separate formations may be separated from one another by natural barriers. One or more of the separate formations may be too thin for economic recovery utilizing the SAGD. Further, the separate formations can present various control problems with the in situ combustion. For example, the injection and/or production wells utilized for the in situ combustion processes may lead to premature unregulated breakthrough across the separate formations, such as when producing, and may burn up prior to full recovery of the oil without proper control for each of the separate formations.

Therefore, a need exists for improved methods and systems for oil recovery with in situ combustion.

SUMMARY OF THE INVENTION

In one embodiment, a method provides recovering of oil with in situ combustion. The method includes injecting an oxidant through an injection well into a first reservoir to propagate combustion through the first reservoir. Further, the method includes recovering first hydrocarbons through a first production well in fluid communication with the injection well through the first reservoir and recovering second hydrocarbons through a second production well disposed in a second reservoir and spaced from the first production well. The first and second reservoirs are stratified with the first reservoir separated from the second reservoir by a stratum having lower permeability than the first and second reservoirs. In addition, the stratum isolates one of the first and second production wells from one of the first and second reservoirs.

According to one embodiment, a production system for recovering oil with in situ combustion includes an injection well coupled to an oxidant supply. The system further includes a first production well completion in fluid communication with the injection well through a first reservoir and a second production well completion in fluid communication with a second reservoir and spaced from the first production well completion. The first and second reservoirs are stratified with the first reservoir separated from the second reservoir by a stratum having lower permeability than the first and second reservoirs. Further, the stratum isolates one of the first and second production well completions from one of the first and second reservoirs.

For one embodiment, a method of recovering oil with in situ combustion includes injecting an oxidant into a first reservoir ignited to conduct the in situ combustion. A burn zone of the in situ combustion is defined by sweep of a combustion front from ignition until extinguished. The method also includes recovering through a first production well extending through the first reservoir first hydrocarbons heated by the in situ combustion and recovering second hydrocarbons through a second production well. The in situ combustion heats the second hydrocarbons within a second reservoir that is separated by a barrier from the first reservoir. The second production well extends from surface through the second reservoir and terminates without extending into the burn zone for the in situ combustion.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Embodiments of the invention relate to in situ combustion. Configurations of injection and production wells facilitate the in situ combustion. A first production well disposed in a first oil bearing reservoir is spaced from a second production well disposed in a second oil bearing reservoir separated from the first oil bearing reservoir by a stratum having lower permeability than the first and second oil bearing reservoirs. The stratum isolates one of the first and second production wells from one of the first and second oil bearing reservoirs. In situ combustion through the first oil bearing reservoir generates heat that irradiates into the second oil bearing reservoir to enable producing hydrocarbon with the second production well.

Figure 1:
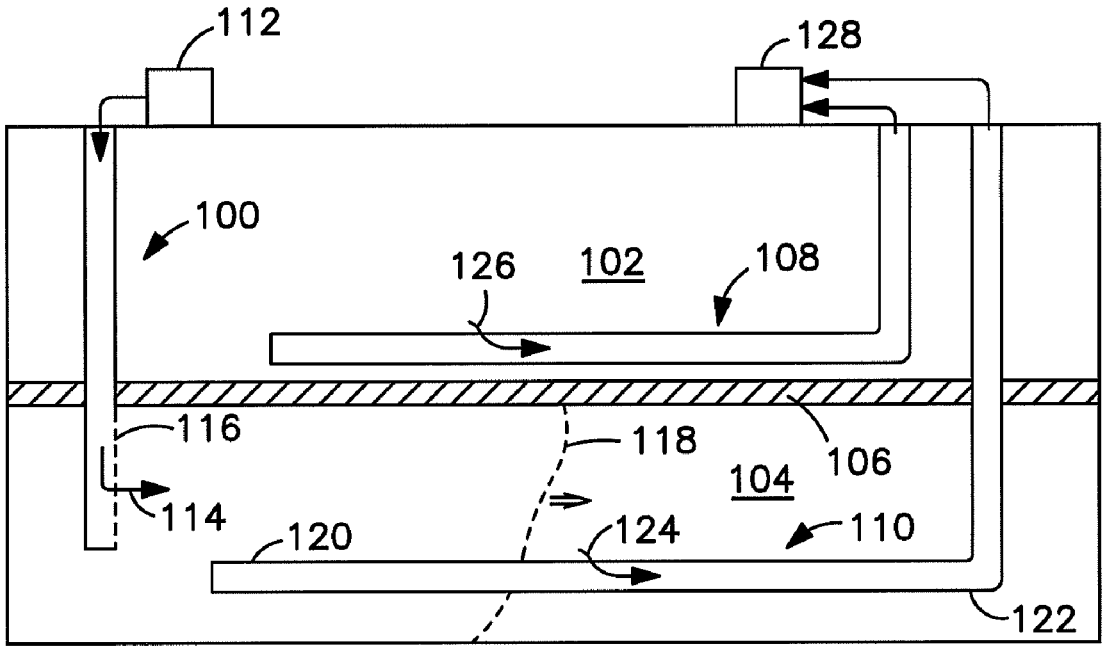
FIG. 1 is a schematic sectional side view of an injection well and production wells that are disposed with an impermeable stratum between one another to contain in situ combustion within an oil bearing reservoir below the impermeable stratum, according to one embodiment of the invention.

FIG. 1 illustrates an injection well 100 disposed in a formation that includes an oil bearing first reservoir 102, an oil bearing second reservoir 104 and a barrier stratum 106 stratified with the stratum 106 located between the first and second reservoirs 102, 104. A first production well 108 extends through the first reservoir 102 located above the stratum 106 without intersecting the stratum 106. A second production well 110 passes through the second reservoir 104 and is in fluid communication with the injection well 100 via the second reservoir 104. The stratum 106 isolates the first production well 108 from the second reservoir 104 located below the stratum 106.

The stratum 106 creates this isolation by being less permeable than the first and second reservoir 102, 104. In some embodiments, the stratum 106 may block fluid communication between the first and second reservoir 102, 104 and is hence impermeable. A layer of shale provides an example of the stratum 106.

For some embodiments, the production wells 108, 110 may each define horizontal portions that are parallel to one another. Further the horizontal portions of the production wells 108, 110 may align on top of one another. This correspondence in orientation and placement of the production wells 108, 110 locates the first production well 108 along regions heated by heat irradiated from in situ combustion that progresses as described herein along the horizontal portion of the second production well 110. While a direct relationship between the first and second production wells 108, 110 is possible, the first production well 108 may intersect the first reservoir 102 anywhere the first reservoir 102 is in thermal proximity to areas of the second reservoir 104 burned during the in situ combustion.

In operation, an oxidant source 112 such as an air compressor introduces an oxidant 114 into the second reservoir 104. Examples of the oxidant 106 include oxygen or oxygen-containing gas mixtures. The injection well 100 conveys the oxidant 114 to below the stratum 106 and may include casing or liners cemented in place. Open borehole, slotted liner, or perforated liner sections 116 within the injection well 100 limit locations for outflow of the oxidant 114 from an interior of the injection well 100. Even if intersecting the first formation 102, the injection well 100 may be sealed above the stratum 106 once cemented in place such that the oxidant 114 is prevented from entering the first reservoir 102.

Initiation of the in situ combustion begins with ignition of the second reservoir 104. Injection of the oxidant 114 propagates a combustion front 118 through the second reservoir 104 toward the second production well 110. For some embodiments, the second production well 110 deviates from vertical toward the injection well 100 with a toe 120 at a distal terminus of the second production well 110 being closest to the injection well 100. The combustion front 118 thus advances from the toe 120 to a heel 122 of the second production well 110 where the second production well 110 deviates from vertical. Second formation mobile oil 124 flows into the second production well 110 ahead of the combustion front 118.

Temperatures at the combustion front 118 can reach in excess of 350° C. Since this heat irradiates to adjacent and surrounding regions, the in situ combustion through the second reservoir 104 heats the stratum 106 and then the first reservoir 102. Heating of the first reservoir 102 reduces viscosity of hydrocarbons therein. With the viscosity reduction, first reservoir mobile oil 126 flows into the first production well 108.

Production equipment 128 including hydrocarbon storage tanks receive the mobile oil 124, 126 produced from the production wells 108, 110. Separate completions for the first and second production wells 108, 110 enable independent control of production through each of the first and second production wells 108, 110. Customizing production procedures such as durations, flow rates, and secondary recovery approaches including fluid flooding enables depletion of the reservoirs 102, 104 according to criteria specific to each of the reservoirs 102, 104. By contrast to an open production well in fluid communication with both the first and second reservoirs 102, 104, the first production well 108 and the second production well 110 permit this customization.

Further, the first production well 108 lacks any portion where the in situ combustion occurs in the second reservoir 104. The first production well 108 thereby remains protected from being burned by the in situ combustion. Since the first production well 108 is not damaged by the in situ combustion as is possible if the first production well 108 extends into where the in situ combustion occurs, production can continue through the first production well 108 even after completion of the in situ combustion in the second reservoir 104. Continuing production through the first production well 108 after the in situ combustion through the second reservoir 104 provides time for the heat from the in situ combustion to dissipate through the first reservoir 102 and time for the first reservoir mobile oil 126 to migrate into the first production well 108.

For some embodiments, the combustion front 118 passes through the second reservoir 104 without burning of the first reservoir 102 at any time between initiating the in situ combustion in the second reservoir 104 and when the combustion front 118 is extinguished. Even if the injection well 100 traverses part of the first reservoir 102, any regions of the first formation 102 surrounding the injection well 100 remain unburned as the combustion front 118 contained within the second reservoir 104 progresses away from against the injection well 100 since the oxidant 116 is at least initially introduced into only the second reservoir 104. Production of the first reservoir mobile oil 126 through the first production well 108 occurs concurrently while conducting the in situ combustion of the second reservoir 104 and without igniting the first reservoir 102.

Figure 2:
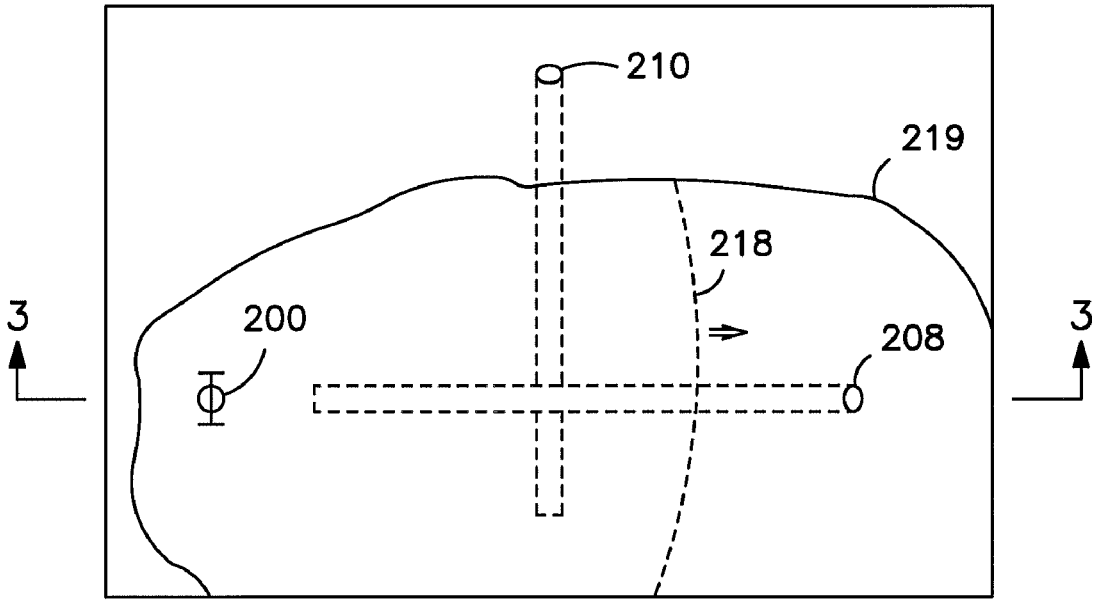
FIG. 2 is a schematic top view of an injection well and production wells that are disposed with an impermeable stratum between one another to contain in situ combustion within an oil bearing reservoir above the impermeable stratum, according to one embodiment of the invention.
Figure 3:
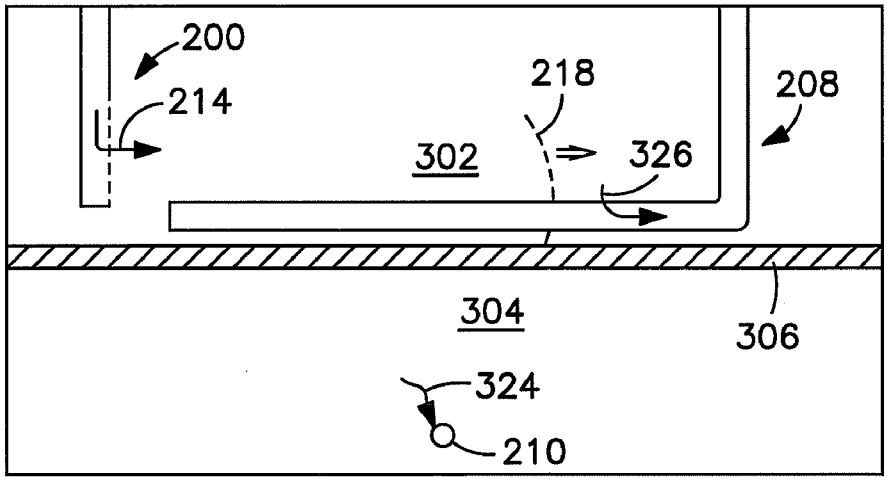
FIG. 3 is a schematic sectional side view of the injection well and production wells taken along line 3-3 of FIG. 2, according to one embodiment of the invention.

FIGS. 2 and 3 show schematic top and side views of an exemplary configuration for an injection well 200 and first and second production wells 208, 210. Similar to FIG. 1, a formation through which the wells 200, 208, 210 are disposed includes an oil bearing first reservoir 302. an oil bearing second reservoir 304 and a barrier stratum 306 stratified with the stratum 306 located with the first reservoir 302 above the stratum 306 and the second reservoir 304 below the stratum 306. In contrast to the operation described with respect to FIG. 1, in situ combustion occurs, as depicted by a combustion front 218, in the first reservoir 302 to heat the second reservoir 304. The combustion front 218 advances from the injection well 200 toward or along the first production well 208. An areal extent of combustion 219 extends through the first reservoir 208 out from the injection well 200 and encompasses the first production well 208.

Neither the injection well 200 nor the first production well 208 intersect the stratum 306. The stratum 306 isolates both the injection well 200 and the first production well 208 from the second reservoir 304. The stratum 306 thus blocks oxidant 214 supplied through the injection well 200 from entering the second reservoir 304 and contains the in situ combustion to within the first reservoir 302.

The first and second production wells 208, 210 provide benefits as discussed herein with respect to FIG. 1. First reservoir mobile oil 326 flows into the first production well 208 due to pressure gradients and heating created ahead of the combustion front 218. The second reservoir 304 at areas in thermal proximity to the areal extent 219 of the first reservoir 302 burned during the in situ combustion becomes sufficiently heated to allow second reservoir mobile oil 324 to flow into the second production well 210. Even without introducing heat other than that generated by the in situ combustion of the first reservoir 302, the second reservoir mobile oil 324 may come from any part of the second reservoir 304 separated from the first reservoir in a vertical direction and corresponding to at least the areal extent 219 of the first reservoir 302 burned during the in situ combustion.

Conducting the in situ combustion in the first reservoir 302 that is located above the second reservoir 304 can influence placement of the second production well 210. In particular, any place that the second production well 210 is drilled from surface to the second reservoir 304 inside of the areal extent 219 of the first reservoir 302 burned during the in situ combustion may experience thermal damage when the combustion front 218 passes unless drilled subsequent to passage of the combustion front 218. Drilling through the first reservoir 302 where already burned provides access to the second reservoir 304 but requires drilling through zones with temperatures and pressures increased by the in situ combustion. As shown, location of a vertical section of the second production well 210 away from burn zones enables bypassing without intersecting the areal extent 219 of the first reservoir 302 burned during the in situ combustion since only a horizontal section of the second production well 210 extends under the areal extent 219 of the first reservoir 302 burned during the in situ combustion. While parallel relationships (see, FIG. 1) or other angles are possible, the horizontal section of the second production well 210 exemplifies a perpendicular relationship relative to vertical deviation of the first production well 208. Drilling the second production well 210 prior to the in situ combustion avoids potential safety issues associated with drilling while possible for the in situ combustion to burn out of control, even though the second production well 210 may be drilled before, during or after the in situ combustion in the first reservoir 302.

Figure 4:
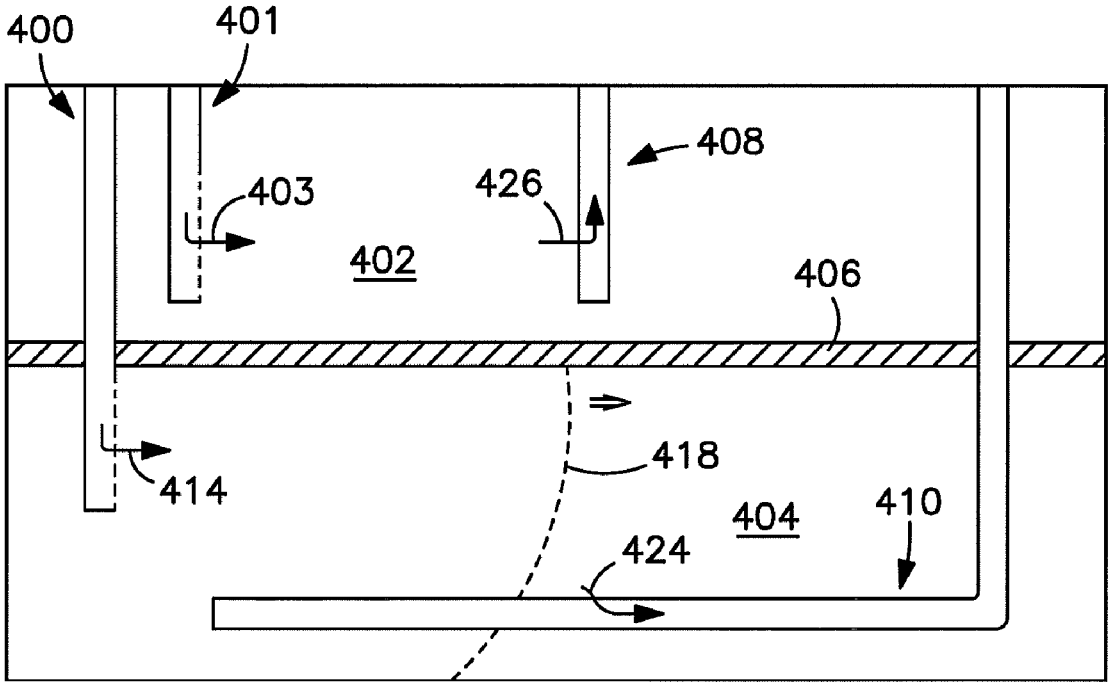
FIG. 4 is a schematic sectional side view of a formation having an impermeable stratum separating oil bearing reservoirs and showing an in situ combustion injection well, a fluid flooding injection well, and respective production wells disposed in the formation, according to one embodiment of the invention.

FIG. 4 illustrates a formation that, like FIG. 1, includes a stratum 406 separating a first reservoir 402 above the stratum 406 from a second reservoir 404 below the stratum 406. An in situ combustion injection well 400 provides a flow path isolated from the first reservoir 402 for conveying oxidant 414 from surface to the second reservoir 404. A fluid flooding injection well 401 and a first production well 408 both extend through the first reservoir 402 located above the stratum 406 without intersecting the stratum 406. A second production well 410 passes through the second reservoir 404 and is in fluid communication with the in situ combustion injection well 400 via the second reservoir 404. The stratum 406 isolates the first production well 408 from the second reservoir 404 located below the stratum 406.

During the in situ combustion, injection of the oxidant 414 propagates a combustion front 418 through the second reservoir 404 in a toe-to-heel direction with respect to the second production well 410. As with the operation described with respect to FIG. 1, the in situ combustion remains contained within the second reservoir 404 without burning of the first reservoir 402. Second formation mobile oil 424 flows into the second production well 410 ahead of the combustion front 418.

Heat from the in situ combustion transfers across the stratum 406 and raises temperatures within the first reservoir 402. A fluid 403 such as water and/or inert gas supplied through the fluid flooding injection well 401 facilitates in driving first reservoir mobile oil 426 into the first production well 408. For some embodiments, hydrogen and/or catalysts for in situ hydro-cracking form the fluid 403. Other than aforementioned heat transfer, such flooding procedures do not impact the in situ combustion, and vice-versa, since the fluid flooding injection well 401 and the first production well 408 lack fluid communications with the in situ injection well 400 and the second production well 410. In some embodiments, the fluid flooding in the first reservoir 402 occurs simultaneous with the in situ combustion in the second reservoir 404.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method of recovering oil with in situ combustion, comprising:

injecting an oxidant through an injection well into an oil bearing first reservoir to propagate combustion through the first reservoir;

recovering first hydrocarbons through a first production well in fluid communication with the injection well through the oil bearing first reservoir, wherein the first reservoir and an oil bearing second reservoir are stratified with the first reservoir separated from the second reservoir by a stratum having lower permeability than the first and second reservoirs; and recovering second hydrocarbons through a second production well disposed in the second reservoir and spaced from the first production well, wherein the stratum isolates one of the first and second production wells from one of the first and second reservoirs.

2. The method according to claim 1, wherein the stratum isolates the second production well from the first reservoir below the stratum by the second production well terminating distal from surface without intersecting the stratum.

3. The method according to claim 1, wherein the stratum isolates the first production well from the second reservoir below the stratum by the first production well terminating distal from surface without intersecting the stratum.

4. The method according to claim 1, wherein the first production well is in fluid communication with the first reservoir and obstructed from fluid communication with the second reservoir and the second production well is in fluid communication with the second reservoir and obstructed from fluid communication with the first reservoir.

5. The method according to claim 1, further comprising introducing a fluid into the second reservoir to drive the second hydrocarbons toward the second production well.

6. The method according to claim 1, wherein the stratum is impermeable.

7. The method according to claim 1, wherein the stratum comprises a layer of shale.

8. The method according to claim 1, further comprising introducing a fluid through a borehole and into the second reservoir to drive the second hydrocarbons toward the second production well, wherein the borehole terminates distal from surface without intersecting the stratum to isolate the borehole from the first reservoir below the stratum.

9. The method according to claim 1, wherein the first and second production wells each have portions deviated from vertical.

10. The method according to claim 1, wherein the first and second production wells each have portions deviated from vertical parallel to one another.

11. The method according to claim 1, wherein the first reservoir is located below the stratum.

12. The method according to claim 1, wherein the second production well extends toward horizontal through part of the second reservoir separated from the first reservoir in a vertical direction and corresponding to an areal extent of the first reservoir burned during the in situ combustion.

13. A method of recovering oil with in situ combustion, comprising:

injecting an oxidant into an oil bearing first reservoir ignited to conduct the in situ combustion, wherein a burn zone of the in situ combustion is defined by sweep of a combustion front from ignition until extinguished;

recovering through a first production well extending through the first reservoir hydrocarbons heated by the in situ combustion; and recovering through a second production well hydrocarbons heated by the in situ combustion and in an oil bearing second reservoir separated by a barrier from the first reservoir, wherein the second production well extends from surface through the second reservoir and terminates without extending into the burn zone for the in situ combustion.

14. The method according to claim 13, wherein the second production well extends toward horizontal through part of the second reservoir separated in a vertical direction from the burn zone of the first reservoir.

* * * * *